US006994129B2

(12) United States Patent
Fesko

(10) Patent No.: US 6,994,129 B2
(45) Date of Patent: Feb. 7, 2006

(54) FLUID BOTTLE WITH REFILL BOTTLE OPENER

(75) Inventor: Timothy J. Fesko, Canton, MI (US)

(73) Assignee: Key Plastics, LLC, Northville, MI (US)

( * ) Notice: Subject to any disclaimer, the term of this patent is extended or adjusted under 35 U.S.C. 154(b) by 0 days.

(21) Appl. No.: 10/974,659

(22) Filed: Oct. 27, 2004

(65) Prior Publication Data

US 2005/0092391 A1 May 5, 2005

Related U.S. Application Data

(60) Provisional application No. 60/515,253, filed on Oct. 29, 2003.

(51) Int. Cl.
*B65D 1/04* (2006.01)

(52) U.S. Cl. ..... 141/330; 141/18; 141/319; 141/329

(58) Field of Classification Search ..... 141/2, 141/18, 331–345, 329, 330, 319
See application file for complete search history.

(56) References Cited

U.S. PATENT DOCUMENTS 2,002,611 A * 5/1935 Nall et al. ..... 141/330
4,846,236 A * 7/1989 Deruntz ..... 141/329
5,012,954 A * 5/1991 Will ..... 222/5
5,111,910 A * 5/1992 Sheppard, Jr. ..... 184/1.5

* cited by examiner

*Primary Examiner*—Timothy L. Maust
(74) *Attorney, Agent, or Firm*—Markell Seitzman

(57) ABSTRACT

A fluid reservoir, bottle, pump or storage chamber (50, 70, 80) capable of being refilled by a refill bottle (100), the refill bottle including an outlet passage (106) closed by a fluid seal (104), the fluid reservoir, bottle or storage chamber comprising: an inlet passage (44, 52, 60, 74, 84); a housing (202, 204, 206) for receiving and supporting the refill bottle (100) in an orientation to encourage fluid in the refill bottle to flow into the inlet passage of the fluid reservoir bottle or storage chamber and second means for piercing the fluid seal (104) as the refill bottle is placed upon the first means.

14 Claims, 7 Drawing Sheets

FLUID BOTTLE WITH REFILL BOTTLE OPENER

BACKGROUND AND SUMMARY OF THE INVENTION

This application claims the benefit of U.S. Provisional Application 60/515,253, filed on Oct. 29, 2003. The disclosure of the above application is incorporated herein by reference.

The present invention relates to an apparatus and method for refilling fluid bottles, reservoirs and the like such as containers typically mounted within and about the engine compartment of an automotive vehicle.

It is an object of the present invention to provide an improved mechanism for reestablishing a desired level of various vehicle fluids.

A further object of the present invention is to be able to refill such fluids without the use of a separate funnel. An additional object of the present invention is to automatically tear the foil seal typically used on refill fluid bottles without having first to manually remove the foil or seal. Accordingly the invention comprises: a fluid bottle or storage chamber capable of being refilled by a refill bottle, the refill bottle including an outlet passage closed by a fluid seal, the fluid reservoir, bottle or chamber comprising: an inlet passage; first means for receiving and supporting the refill bottle in an orientation to encourage fluid in the refill bottle to flow into the inlet passage of the fluid reservoir bottle or storage chamber and second means for piercing the fluid seal as the refill bottle is placed upon the first means.

Many other objects and purposes of the invention will be clear from the following detailed description of the drawings.

DETAILED DESCRIPTION OF THE DRAWINGS

Figures 1, 2:
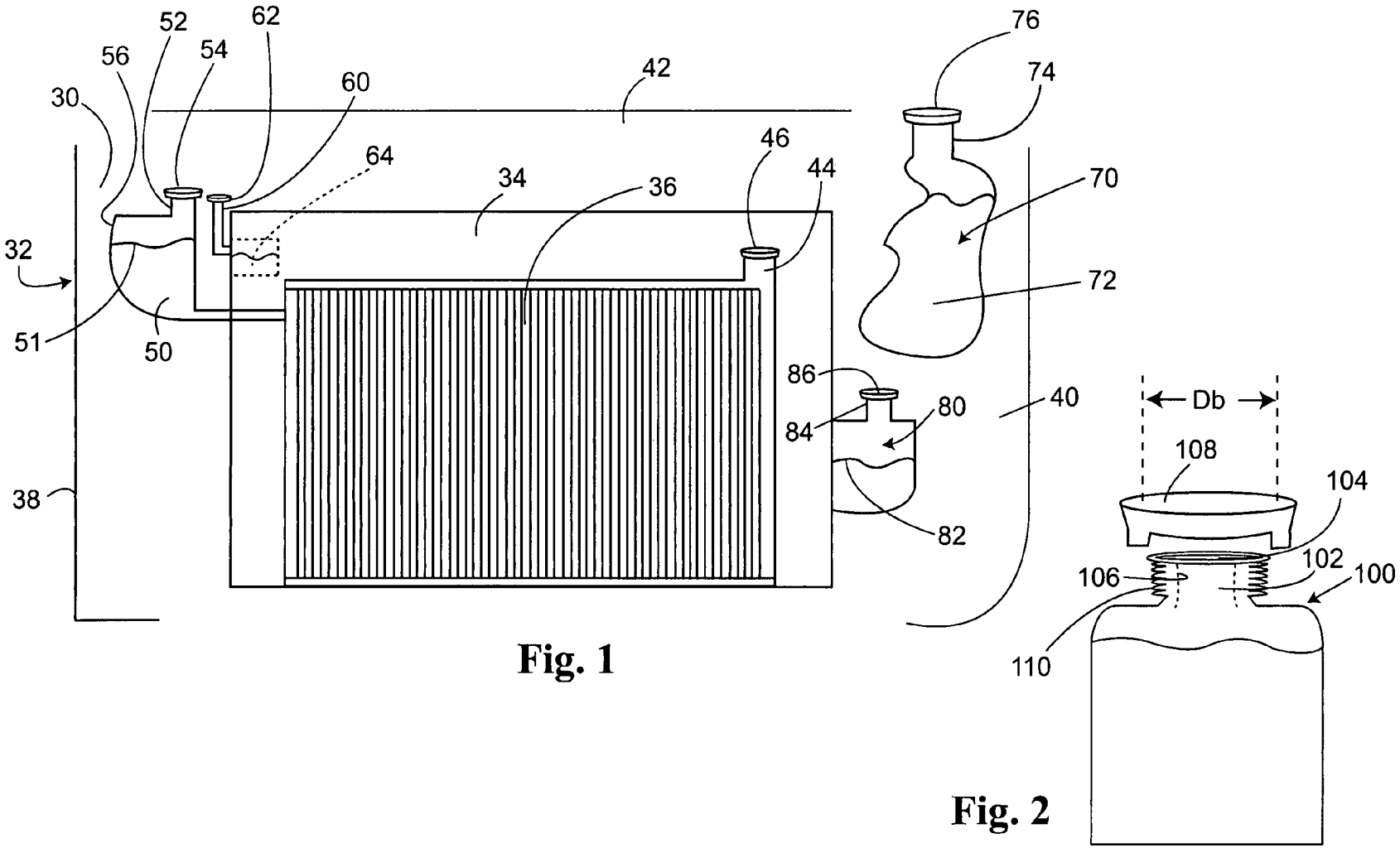
FIG. 1 diagrammatically illustrates an engine compartment of a motor vehicle.
FIG. 2 diagrammatically illustrates the construction of a typical fluid carrying refill bottle.

FIG. 1 diagrammatically represents an engine compartment 30 of a typical motor vehicle 32. The engine 34 and cooperating radiator 36 are typically positioned between the inner fender walls 38 and 40 and below the hood 42. The radiator 36 typically includes a snorkel or inlet 44, which is closed by a manually sealed cap 46. Associated with the radiator is an expansion tank, chamber, reservoir or bottle 50 having a snorkel or inlet passage 52, which is sealed by a manually displaceable cap 54. For the sake of generality, the bottle 50 is shown having an arbitrary shape (see numeral 56) to show these bottles or chambers can be molded to fit within the available space within and about the engine compartment 30. Numeral 51 is representative of the antifreeze that is stored within the tank, chamber, reservoir or bottle 50.

The engine 34 includes another fluid inlet passage such as a fill tube 60 for replenishing engine oil. This tube 60 is typically closed by a removable (press-fit or threaded) cap 62. Numeral 64 diagrammatically illustrates the engine oil within the engine 34 (as used herein the engine is generally referred to as the reservoir for the oil as well as refill oil/fluid).

Additionally, another fluid reservoir 70 is located within or proximate the engine compartment. This fluid reservoir (chamber or bottle) 70 typically stores windshield wiper fluid shown as numeral 72. The reservoir, chamber or bottle 70 includes an inlet passage or neck 74, enclosed by a resealable cap 76.

Numeral 80 designates the power steering pump with the power steering fluid shown by numeral 82. The power steering pump typically includes another inlet passage, snorkel or neck 84, which is closed by a resealable lid 86.

Reference is made to FIG. 2, which illustrates a typical fluid refill bottle 100 for automotive fluids, which is often made of a blow-molded or injection-molded plastic. The bottle 100 includes a hollow neck 102, which serves as both an inlet and exit passage for the replacement fluid. The neck is sealed with, for example, a thin aluminum foil 104 that is typically sealed or glued to the bottle 100 about the peripheral edge of the open mouth of the neck 102. The length of the neck and the volume of the refill bottle 100 will vary with the use of the refill bottle. The neck and in particular the exit passage 106 thereof is sealed by a manually removable cap 108, which is often threaded in place or snapped on the bottle 100. The bottle 100 may include exterior threads 110 in which case the cap will also include mating threads and is threaded upon the bottle. Alternatively, the cap 108 is designed to snap upon a rim or ridge located about the end of the neck 102 (not shown).

During the normal operation of the vehicle, a mechanic or operator of the vehicle will typically check the sufficiency of the various fluids in the vehicle such as the level of antifreeze, motor oil, power steering fluid and windshield washer solvent. If the level of such fluid or fluids is sufficiently low, the mechanic or operator will obtain replacement fluid, which is typically stored in a refill bottle or container 100, such as illustrated in FIG. 2. Subsequently, the aluminum foil 104 is manually pierced or removed. The respective lid or cap 46, 54, 76 or 86 of the vehicle mounted reservoir is removed; a funnel is inserted within the inlet passage or fill tube of the vehicle mounted reservoir; and subsequently the bottle 100 with the replacement fluid is inverted and the fluid is transferred to the respective fluid storage container within the vehicle.

Some mechanics and vehicle operators will try to not use a funnel when refilling vehicle fluids by slowly tipping and carefully aiming the fluid at the open mouth of inlet passage of each respective reservoir. This procedure is often unsuccessful with fluid pouring on the engine and onto an adjacent floor.

Figure 3:
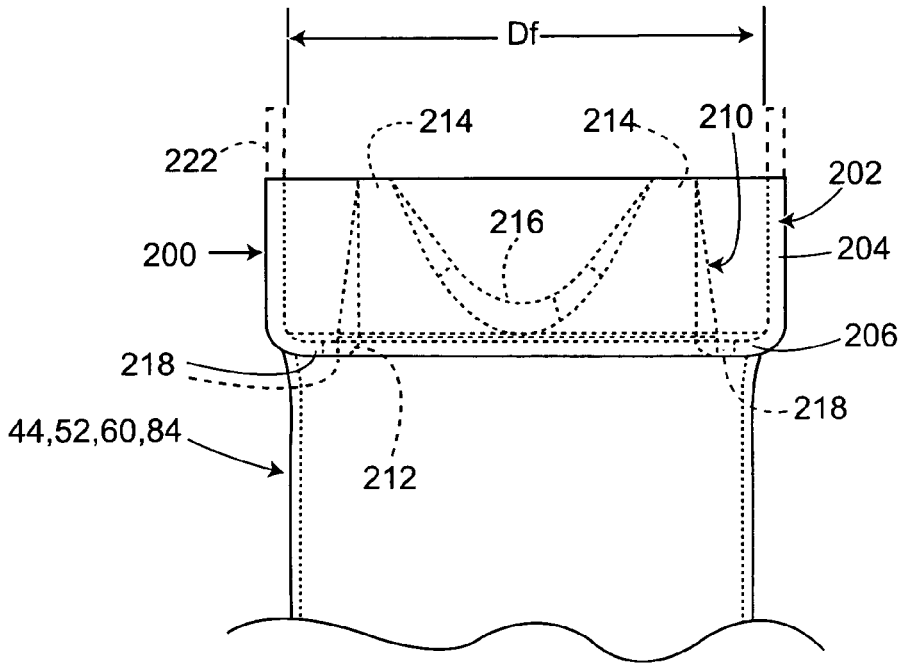
FIG. 3 is a side plan view illustrating one embodiment of the present invention.

Reference is made to FIG. 3, which illustrates an exemplary inlet passage or tube such as 44, 52, 60, 74 or 84 for receiving one of the above-mentioned fluids and for refilling the associated fluid storage bottle or chamber. In the embodiment shown in FIG. 3, a fill mechanism 200 is integrally formed at the top of the inlet passage 44, 52, 60, 74 and/or 84. The fill mechanism 200 includes a cup-like structure or housing 202 having a peripheral outer wall 204 and a bottom 206. The structure 202 has an open mouth. The bottom 206 extends into the respective inlet passage tube 44, 56, 60, etc. The interior diameter of the wall 204 is designated by $D_f$. The diameter $D_f$ is chosen to be slightly larger than the outer diameter $D_b$ (see FIG. 2) of the neck of the refill bottle. The refill mechanism 200 includes one or more piercing or cutting formations 210, which extend upwardly toward the open mouth of the housing 202 from the bottom 206 or alternately from the walls 204.

Figure 4:
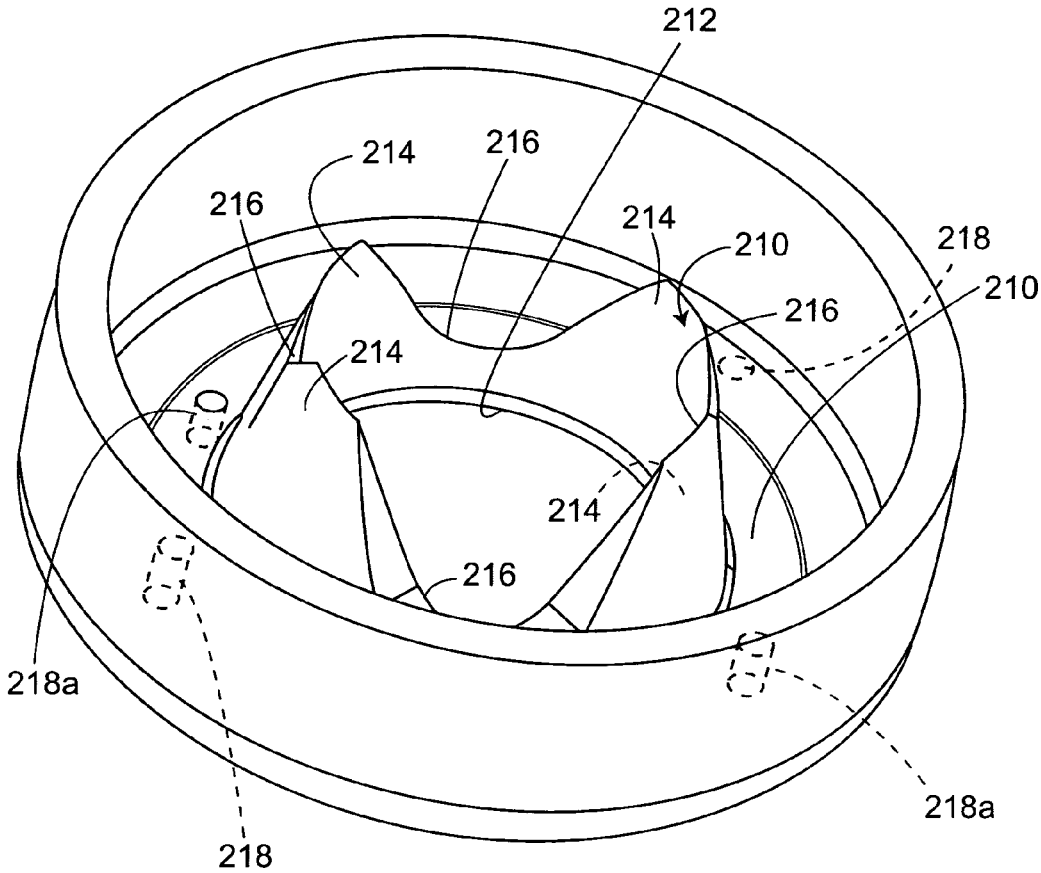
FIGS. 4 and 4*a* are top isometric views showing the major portions of the present invention.
Figure 4A:
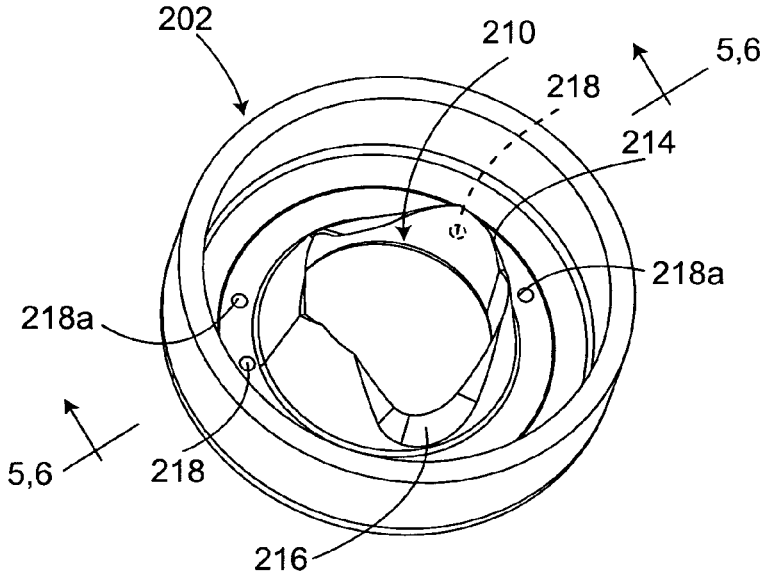

In the embodiment of FIG. 3, these piercing formations 210 are formed as extending projections 214, which extend outwardly from the bottom 206 and surround a central opening 212 (formed by the bottom 206) in the housing 202. In the embodiment shown in FIGS. 3, 4 and 4*a*, the projections 214 taper side-to-side and front-to-back to define a thin blade-like edge about the opening 212. The side and top edges of the projections are pointed and act as piecing or cutting surfaces to cut through the seal as the refill bottle 100 is pushed axially onto the piecing formations 210 or as the refill bottle 100 is rotated relative to the piecing formations 210 and the housing 202. As can be noted in the figures a corresponding recess 216 is located between each projection 214, which facilitates transfer of refill fluid into the receiving reservoir and air out of the receiving reservoir. Reference is also made to FIGS. 4 and 4*a*, which additionally illustrate a plurality of optional drain passages 218 formed in the bottom 206, outboard of the piercing projections 214. These drain passages 218 permit drainage of fluid from the region between the projections 214 and the wall 204.

Figure 5:
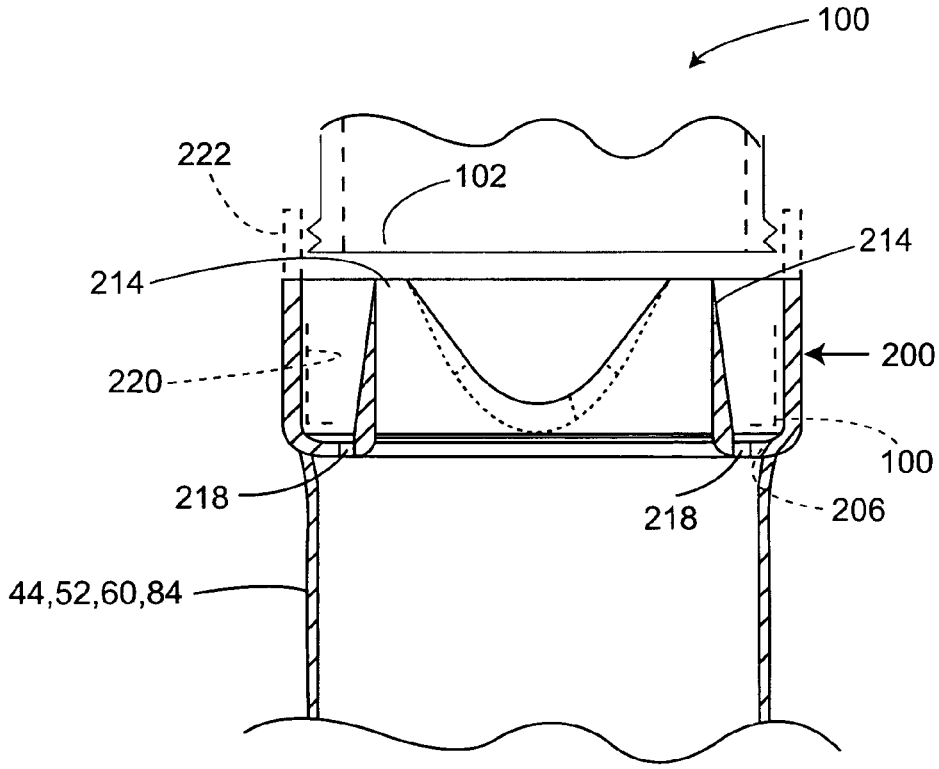
FIG. 5 is a cross-sectional view of a refill bottle showing a use of the present invention.

FIG. 5 illustrates the use of the present invention in which a sealed refill bottle 100, such as a conventionally constructed refill bottle for power steering fluid, windshield washer fluid, oil and/or antifreeze, has been positioned directly above the refill mechanism 200 of the particular reservoir to be refilled. In this orientation none of the piercing projections 214 has pierced the foil seal 104. Subsequently, the refill bottle 100 is pushed down upon the projections 214 or pushed down and simultaneously rotated. The downward placement of the refill bottle 100 upon the bottom 206 is shown by phantom line 220. As the bottle 100 is lowered upon the projections 214, the respective projections 214 tear an opening through the foil seal 104, thereby permitting the refill fluid to enter the inlet 44, 52, 60, 74, 84 of the appropriate reservoir, chamber, pump or bottle 50, 70, 80. After the entire volume of fluid within the refill bottle has been transferred into the appropriate fluid storage chamber or bottle, the refill bottle 100 is removed from the refill mechanism 200.

Reference is again made to FIGS. 3 and 5 and more particularly to the phantom lines 222. These phantom lines show the walls 204 can be lengthened to extend outwardly beyond the dimension of the piercing projections 214.

Placement of the projections 214 and the recesses 216 and the additional drainage openings 218 permits the refill fluid to enter into the storage reservoir, bottle or chamber while permitting air in such reservoir, the storage bottles or chambers to enter into the refill bottle, thereby facilitating and speeding fluid transfer.

Figure 6:
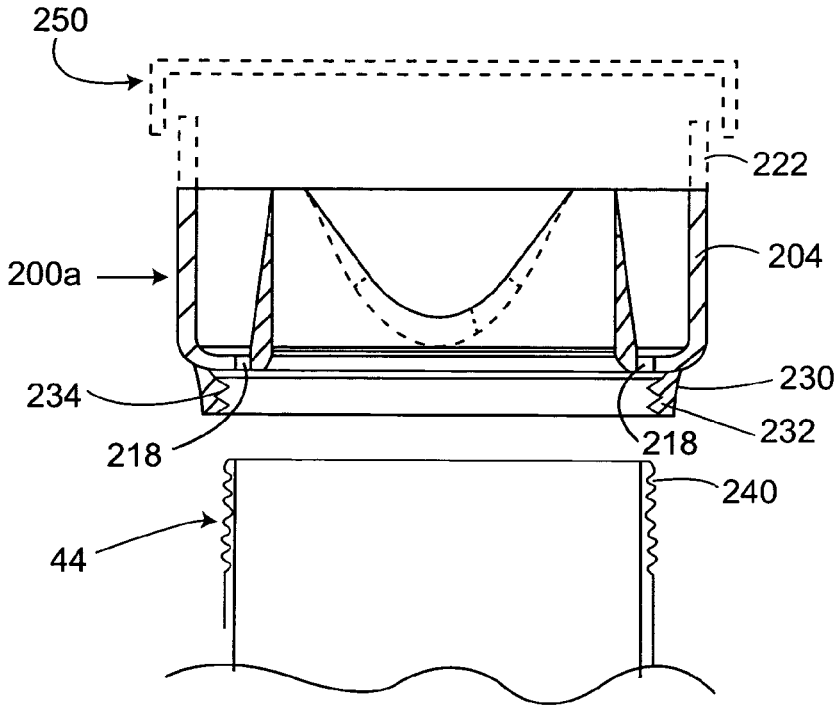
FIG. 6 shows an alternate embodiment of the invention.
Figure 7:
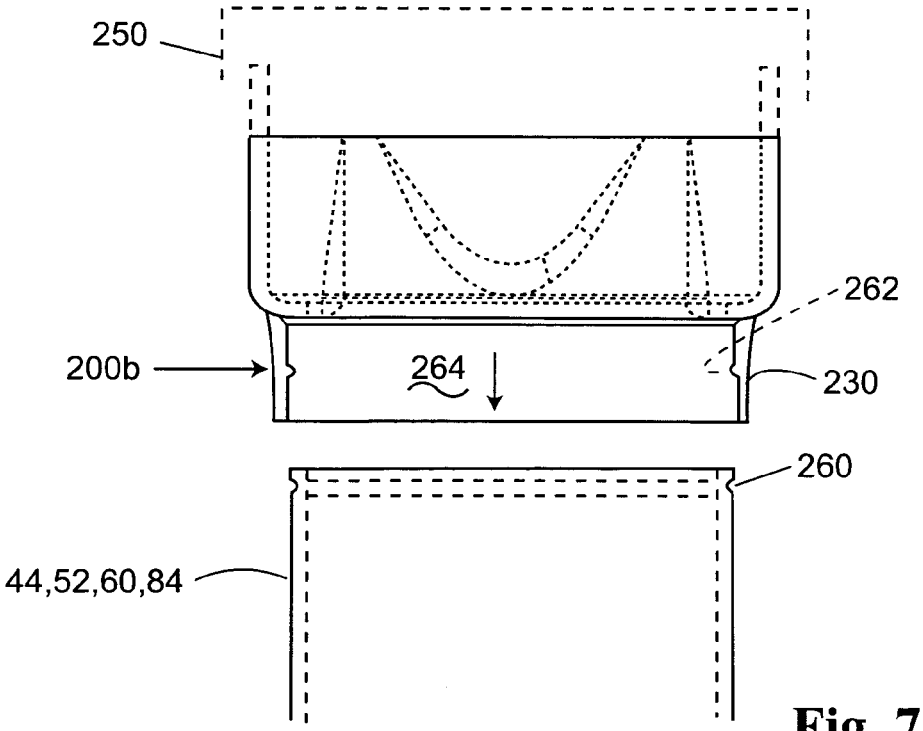
FIG. 7 shows a plan view of a further embodiment of the invention.

FIGS. 6 and 7 illustrate an alternate embodiment of a refill mechanism 200*a*. In the earlier embodiment, the refill mechanism 200 was formed integrally with the fill tube of the fluid reservoir. In this embodiment, the refill mechanism 200*a* is designed to be manually secured to a preexisting fill tube, such as tube 44, 52, 60, 74 and 84. The fill mechanism 200*a* is substantially identical to that shown in FIG. 3 with the exception that the fill mechanism 200*a* includes a downwardly extending neck 230, defining a hollow passage 232. The neck includes an interlocking feature such as a helical thread 234 designed to mate upon the preexisting thread 240 of the inlet, fill tube or neck of the particular reservoir, storage bottle or chamber. In operation, the factory-installed cap enclosing the fill tube is removed and the fill mechanism 200*a* is threaded in place. The fill mechanism 200*a* also includes a replaceable cap 250, which is received upon the wall 204 of housing 202.

For the purpose of illustration, FIG. 7 shows a further embodiment of the invention in which a refill mechanism 200*b* is designed to be attached to a preexisting fill tube or opening of a fluid reservoir. The fill mechanism 200*b* is designed to work with inlet tubes of the class that utilize a snap-fitting cap. Typically these inlet tubes include a peripheral groove 260 to receive a mating projection of the cap (not shown). In FIG. 7, this mating projection 262 is integrated within the neck 230 of the refill housing 202. To attach the refill mechanism 200*b* to the inlet tube, the refill mechanism 200*b* is aligned to the tube and moved downwardly (see arrow 264) until it is snapped in place.

Figure 8:
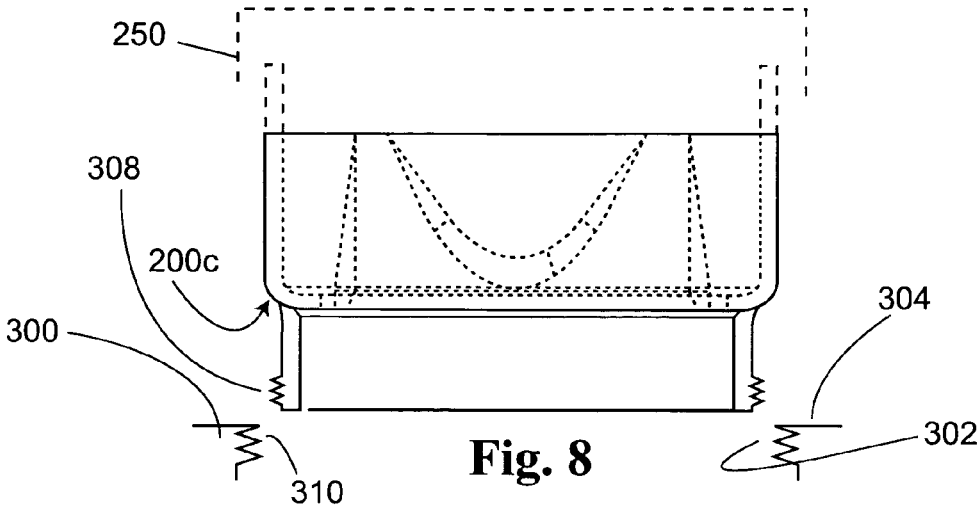
FIG. 8 is a plan view illustrating a further alternative embodiment of the invention.

FIG. 8 shows a further embodiment of the invention, which may have application in regard to refill bottles of engine oil. In some engines the inlet passage is very short or non-existent, see inlet opening 300 in FIG. 8, and may be formed into the engine's valve cover gasket. More particularly, the gasket is formed with an opening 302 that does not extend above the level of the housing 304. The opening 302 is typically threaded for receipt of an oil cap. In the present invention the preexisting oil cap is removed and replaced with the refill mechanism 200*c*, which includes outwardly directed threads 308, which mate with threads 310 about hole 302. This fill mechanism 200*c* may also include a corresponding closure cap 250.

Figure 9:
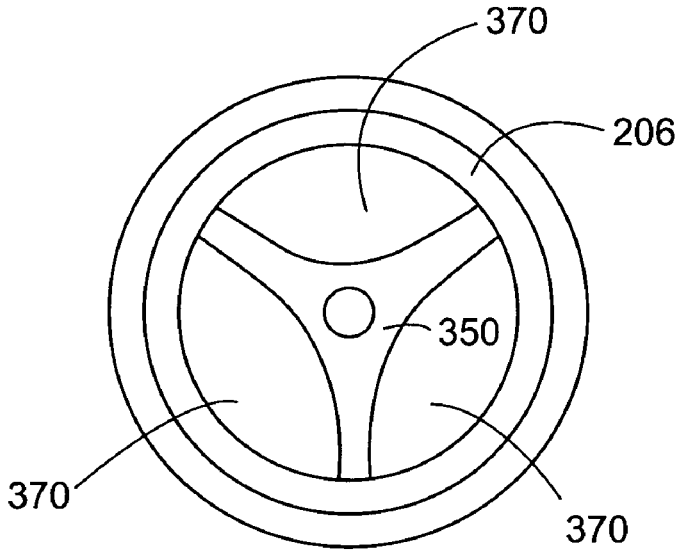
FIGS. 9–10 show a further alternate embodiment of the invention.
Figure 10:
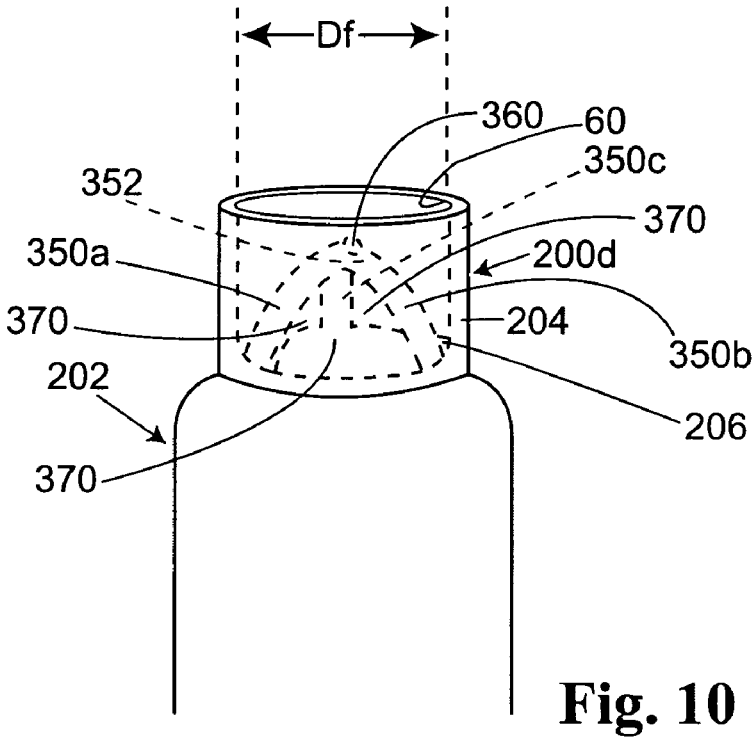

Reference is made to FIGS. 9–10, which illustrate a further embodiment of the present invention. In this embodiment the refill mechanism 200*d* includes a housing 202 having a peripheral wall 204 defining an inlet of diameter $D_f$. Extending upwardly from a bottom 206 of the mechanism 200*d* are three outwardly extending thin ribs 350*a*, 350*b* and 350*c*. Each of the ribs can be arcuately shaped or straight and they are joined together generally at their respective tops shown by numeral 352. This top region 352 is located generally in the center of the housing 202. Additionally, a central opening 360 is formed in the top center region of the ribs. The top region having the opening 360 can be angled to facilitate breaking of the seal 104 of the refill bottle. An edge about the opening 360 formed by the respective ribs 350*a*–350*c* forms at least one piercing formation or projection 362 to facilitate the tearing of the refill bottle seal 102 upon its initial insertion. Upon the breaking of the seal 102, the fluid flows into the storage chamber or bottle through opening 360 as well as through the intra-rib spaces 370.

Figure 11:
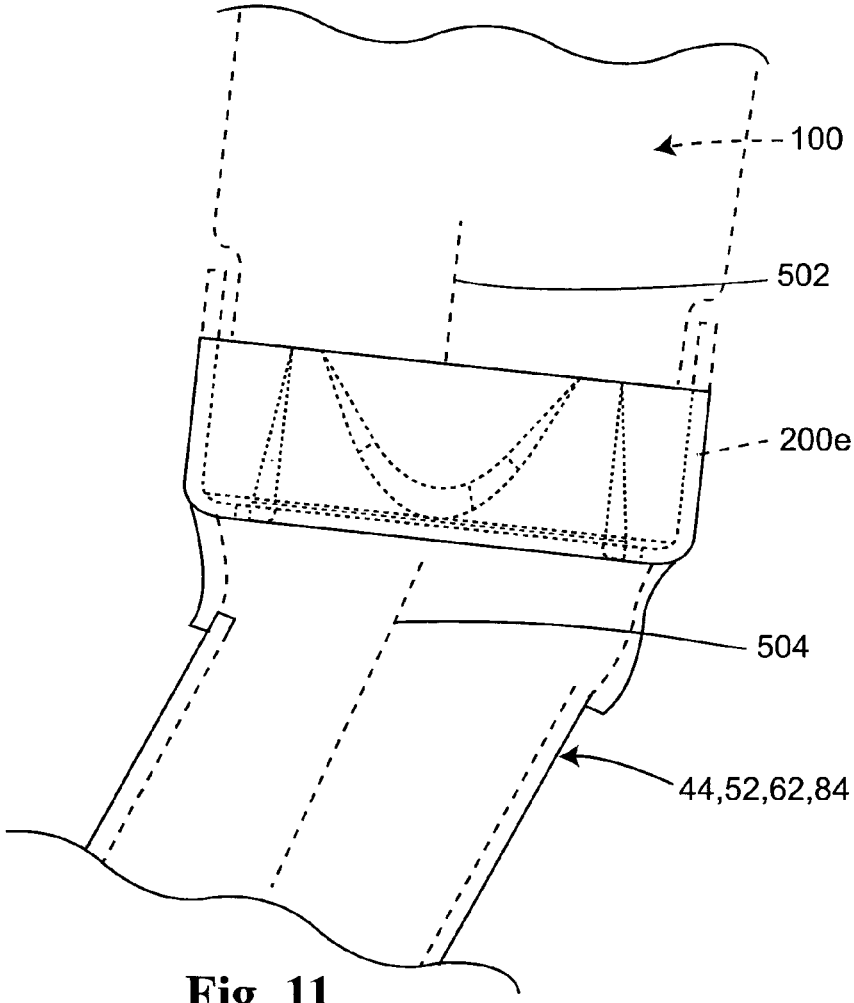
FIG. 11 illustrates a further alternative of the invention.

Reference is briefly made to FIG. 11. One common aspect of the earlier embodiments is the central axis of each of the refill mechanisms is collinear with the central axis of the inlet passage of the reservoir, storage bottle or chamber. The variation of the invention shown in FIG. 12 positions the central axis 502 of the fill mechanism 200*e* at an angle relative to the central axis 504 of the fluid bottle or stored chamber 44, 52, 60, 84. For example, in many vehicle installations the inlet passage of the fluid bottle is vertically oriented; by using the present embodiment the refill bottle 100 can be opened by, for example, projections 214 within the refill bottle 100. In this embodiment the refill bottle is inserted into the refill mechanism at an angle that is off of vertical, which might be more convenient for the mechanic or user.

Figure 12:
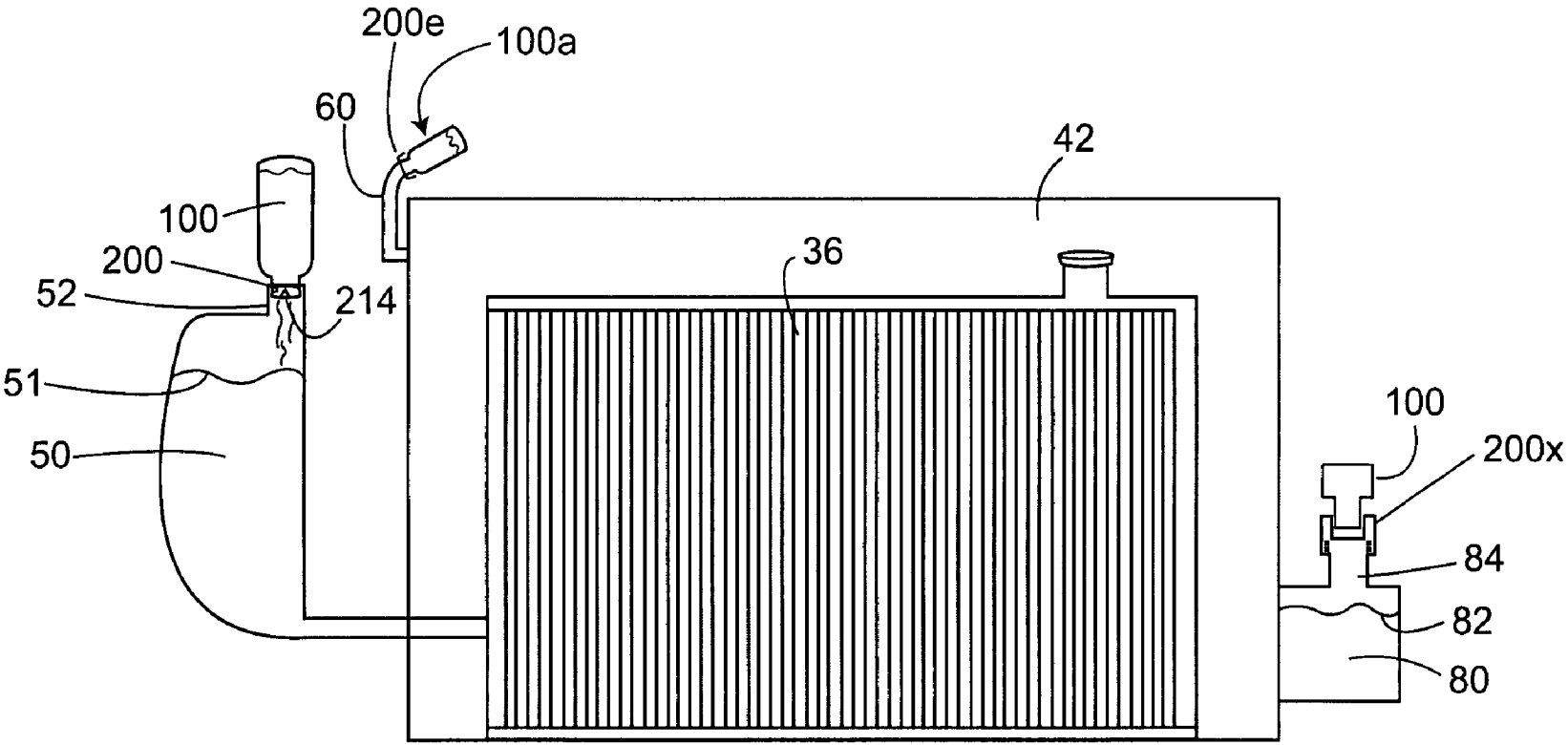
FIG. 12 illustrates the invention in use within an engine compartment.

Reference is made to FIG. 12, which is substantially identical to FIG. 1. In FIG. 12 the coolant reservoir 50, oil fill tube 60 and the power steering reservoir 80 have been modified for use with the present invention. For example, the inlet passage 52 of the coolant reservoir now includes the refill mechanism 200. A coolant refill bottle 100 is shown seated upon the projections 214, which have pierced the fluid seal 104 and replacement coolant flows from bottle 100 into the reservoir 50. The oil fill tube 60 has been modified to receive another refill mechanism 200*e*, which shows the off-set orientation between the refill mechanism 200*e* and the fill passage to receive the off-vertical placement of another type of refill bottle 100*a*, such as a replacement bottle of fuel oil. The steering fluid reservoir 80 and its corresponding inlet 84 have been modified to receive the manually removable refill mechanism 200*c*, which has been threaded into the neck 84 of reservoir 80. Another refill bottle 100 of replacement steering fluid is shown seated upon the refill mechanism 200*a*.

Many changes and modifications in the above-described embodiment of the invention can, of course, be carried out without departing from the scope thereof. Accordingly, that scope is intended to be limited only by the scope of the appended claims.

What is claimed is:

1. A fluid reservoir (50, 70, 80) capable of being refilled by a refill bottle (100) containing refill fluid, the refill bottle including an outlet passage (106) closed by a fluid seal (104), the fluid reservoir comprising:

an inlet passage (44, 52, 60, 74, 84);

a support structure for holding the refill bottle (100) within the inlet passage in an orientation to encourage fluid in the refill bottle to flow into the inlet passage of the fluid reservoir, the support structure having a centrally disposed first opening in a bottom thereof; and a piercing structure configured to surround the first opening, the piercing structure having a continuous first end in contact with the bottom of the support structure and a continuous distal end, portions of the distal end formed into a thin edge to pierce a seal of the refill bottle.

2. The device as defined in claim 1 wherein the first means is integrally formed as part of the inlet passage of the reservoir.

3. The device as defined in claim 1 wherein the support structure is configured to support refill bottle in an orientation that is neither vertical nor horizontal.

4. The device as defined in claim 1 wherein the support structure includes a housing having a central first axis which is configured at a non-zero vertical or horizontal angle relative to the inlet.

5. A fluid reservoir (44, 52, 60, 84) capable of being refilled by a refill bottle (100) containing refill fluid, the refill bottle including an outlet passage (106) closed by a fluid seal (104), the fluid reservoir comprising:

a housing (202) having a bottom with an opening therein defining an inlet passage into the reservoir, a peripheral wall defining an open mouth for receiving the fluid bottle, and an inlet passage (44, 52, 60, 74, 84), the housing configured to receive the refill bottle thereon;

a plurality of spaced ribs configured to pierce the liquid seal as the refill bottle is placed upon the housing, each rib including a first and a second end and a body, each rib spanning the fluid inlet and spaced apart from one another, such spacing not blocking flow of fluid from the refill bottle, each of the first ends joined together at a common location apart from edges of the inlet passage, at least one piecing formation located proximate the common location.

6. The device as defined in claim 5 wherein the at least one piercing formation terminates below an outer end of the wall of the housing.

7. The device as defined in claim 1 including a plurality of piercing elements generally positioned about the opening in the bottom.

8. The device as defined in claim 5 wherein the inlet passage of the reservoir and the housing are configured to present the bottom at an angle that is not horizontal.

9. The device as defined in claim 5 wherein an axis through the inlet passage of the reservoir is generally vertical and wherein a center axis of the housing is angled relative to the axis of the inlet passage.

10. The device as defined in claim 1 wherein the piercing structure includes a tapered wall extending between the first and second ends.

11. The device as defined in claim 1 wherein adjacent portions of the tapered wall, not including the thin edge to pierce the seal, are recessed below the thin edge forming a valley between adjacent thin edges.

12. The device as defined in claim 5 wherein the common location at which the spaced ribs connect includes a second opening for fluid in the refill bottle to flow into the reservoir.

13. The device as defined in claim 1 wherein the first end of the piercing, where it connects to the bottom, is spaced apart by first spacing from a side wall of the inlet passage and wherein the bottom, with this first spacing, includes at least one additional flow opening.

14. A fluid reservoir (44, 52, 60, 84) capable of being refilled by a refill bottle (100) containing refill fluid, the refill bottle including an outlet passage (106) closed by a fluid seal (104), the fluid reservoir comprising:

a housing (202) having a bottom with an opening therein defining an inlet passage into the reservoir, a peripheral wall defining an open mouth for receiving the fluid bottle, and an inlet passage (44, 52, 60, 74, 84), the housing configured to receive the refill bottle on the mouth;

the mouth oriented at an angle to the housing and configured to be installed to a mounting structure so that an axis through the mouth is at an angle that is between vertical and horizontal to facilitate receipt of the refill bottle.

* * * * *